United States Patent [19]

Fromknecht

[11] 4,063,326

[45] Dec. 20, 1977

[54] VACUUM CLEANER SUCTION CONTROL

[75] Inventor: Charles T. Fromknecht, Anderson, S.C.

[73] Assignee: The Singer Company, New York, N.Y.

[21] Appl. No.: 741,449

[22] Filed: Nov. 12, 1976

[51] Int. Cl.[2] ..... A47L 9/00

[52] U.S. Cl. ..... 15/327 R; 15/339; 55/417; 251/228; 251/251; 251/300

[58] Field of Search ..... 15/327 R, 327 D, 327 E, 15/339, 375, 421; 55/413, 414, 415, 417, 309, 310, 311, 312; 251/228, 251, 300

[56] References Cited

U.S. PATENT DOCUMENTS

| | | | |
|---|---|---|---|
| 2,302,972 | 11/1942 | Nuckols | 251/300 X |
| 2,561,964 | 7/1951 | Anderson | 15/375 |
| 2,779,432 | 1/1957 | Meyerhoefer | 55/312 |
| 3,277,512 | 10/1966 | Waters | 15/339 |

*Primary Examiner*—Christopher K. Moore

*Attorney, Agent, or Firm*—Alan Ruderman; Edward L. Bell; Robert E. Smith

[57] ABSTRACT

A canister type vacuum cleaner having mechanism for controlling the negative pressure in the filter bag compartment by bleeding ambient air into the compartment. The mechanism includes a pivotable valve plate for overlaying an aperture in the filter bag compartment and an operator laterally slidable across the front of the cleaner and operatively connected by cam means to the valve. The valve plate is pivoted to selectively block the aperture by an amount determined by the position of the operator and the degree of negative pressure is indicated by the lateral position of the operator.

2 Claims, 4 Drawing Figures

VACUUM CLEANER SUCTION CONTROL

BACKGROUND OF THE INVVENTION

This invention relates to vacuum cleaners and more particularly to canister cleaners having a control for varying the negative pressure in the suction compartment.

The efficient cleaning of most off-the-floor furnishings requires a lower suction than canister cleaners are designed to supply. These cleaners are designed to provide very high suction for cleaning of carpets, and when used for cleaning of curtains, draperies or upholstery, for example, the suction at the inlet of the cleaner hose must be reduced for effective cleaning action. Most of the prior art suction reducing devices have been bleeder valves disposed on the hose wand downstream of the inlet or accessory cleaning tool. Although these generally have been effective, they lack the predictable controllability necessary for the various household cleaning chores. Some of the more recent suction reducing constructions comprise bleeder valves located in the body of the cleaner for reducing the negative pressure in the interior thereof. Examples of three of these prior art controls are illustrated in Russier, U.S. Pat. No. 3,438,081; Bell et al, U.S. Pat. No. 3,566,921 and Hohulin, U.S. Pat. No. 3,779,283. The former patent discloses a rotary valve and the latter two patents disclose push buttons for control of mechanism for varying the amount of by-pass.

SUMMARY OF THE INVENTION

The present invention provides another, yet less complex and less expensive, means of reducing the suction in the cleaner. To this end a valve plate having a cam groove is pivotably mounted on a floor of the suction chamber for movement between positions covering and uncovering an aperture formed in the floor, and a laterally slidable operator connected at one end to a follower positioned within the cam groove has another end extending externally of the cleaner through a slot formed in a bonnet enclosing the valve and the aperture. The bonnet has indicia laterally aligned with the slot for illustrating by registration of the operator the relative suction selected.

Consequently, it is a primary object of the present invention to provide a simple and inexpensive vacuum cleaner suction control for selectively bleeding ambient air into the suction chamber for adjustably reducing the suction at the inlet of the cleaner.

It is another object of the present invention to provide a canister vacuum cleaner with a suction control having a pivotable valve member controlled by a slidable operator the lateral position of which indicates the relative pressure in the suction chamber.

BRIEF DESCRIPTION OF THE DRAWINGS

These and other objects of this invention will best be understood upon reading the following detailed description of the invention with the accompanying drawings, in which.

DESCRIPTION OF THE PREFERRED EMBODIMENT

Figure 1:
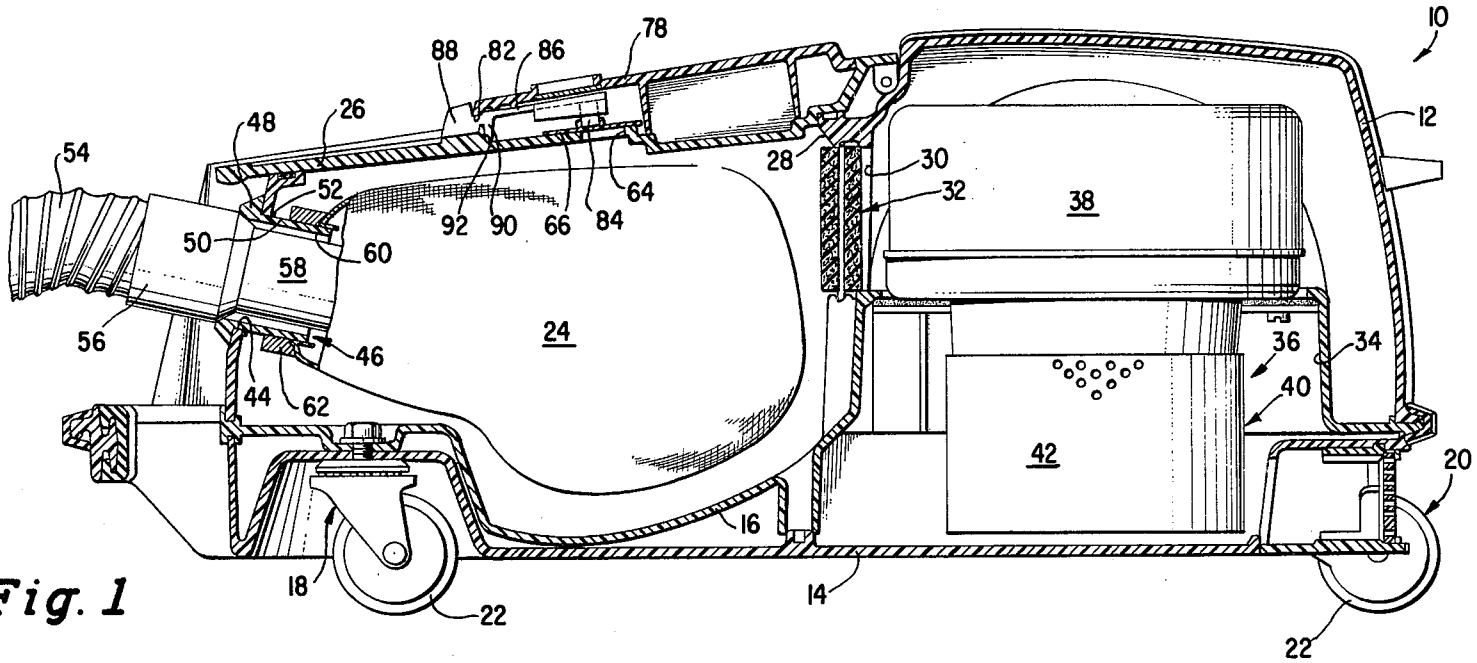
FIG. 1 is a vertical sectional view substantially along the longitudinal center line of a vacuum cleaner embodying the present invention.
Figure 3:
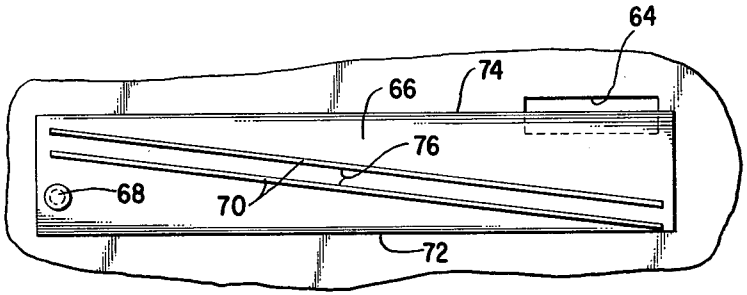
FIG. 3 is a fragmentary top plan view of the filter bag cover of the cleaner of FIG. 1 with the bonnet removed.
Figure 2:
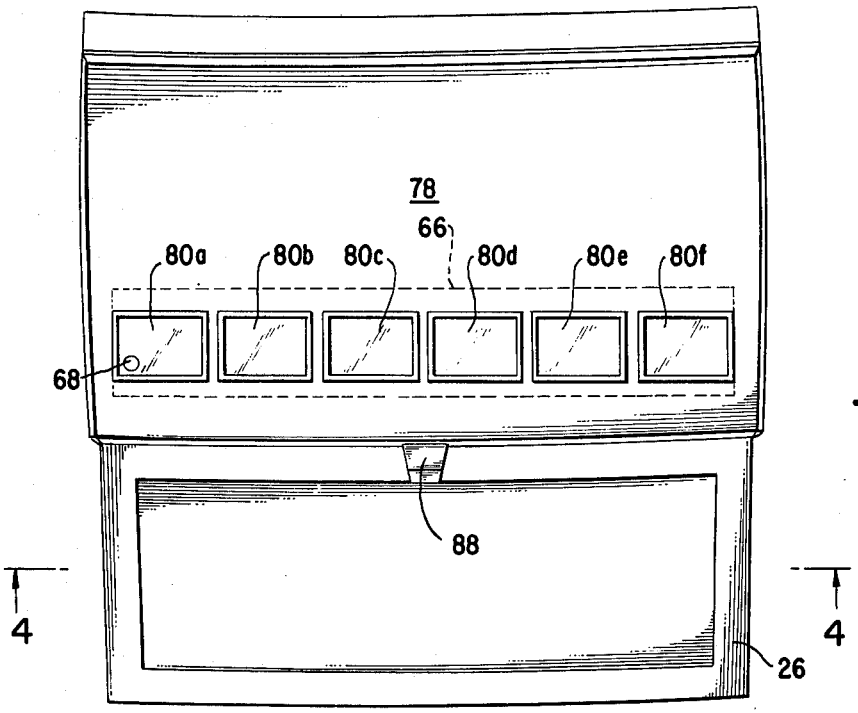
FIG. 2 is a top plan view of the filter bag cover of the cleaner illustrated in FIG. 1.
Figure 4:
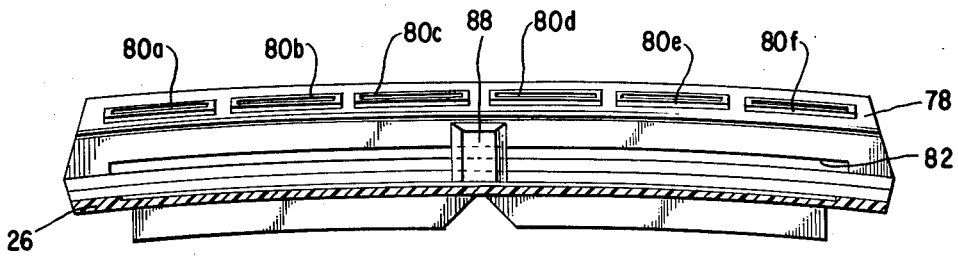
FIG. 4 is a cross-sectional view taken substantially along line 4—4 of FIG. 2.

Referring now to the accompanying drawings wherein like reference numerals denote similar parts throughout the several views, there is disclosed a canister vacuum cleaner 10 comprising a frame having an upper housing 12, a lower housing 14, and a bulkhead or intermediate housing 16 trapped between the upper and lower housings in sandwich-like relationship. The three housings are fitted together and secured by conventional means. Front and rear wheel assemblies 18 and 20 which includes wheels 22 to allow manipulation of the cleaner aid in securing the lower housing 14 to the bulkhead 16. For a more thorough description of the cleaner, reference may be made to Batson et al, U.S. Pat. No. 3,668,842 assigned to the assignee of the present application.

A vacuum compartment within which is located a porous air permeable filter bag 24 is formed by the walls of the bulkhead 16, the upper housing 12 and a plastic molded filter bag access door 26 which is fitted over a recessed opening 28 in the upper housing. The door may be shut and latched to provide a substantially airtight seal for the vacuum compartment. Mounted in the vacuum or filter bag compartment in front of a pair of openings 30 formed in a partition wall (not shown) is a washable permanent secondary filter 32 described in the aforesaid Batson et al, patent. The bulkhead 16 is formed at the rear thereof with a molded pocket 34 within which is mounted a motor-blower assembly 36 which may be of any suitable standard construction. The air moving or motor-blower assembly 36 preferably comprises a two stage fan unit 38 and a coaxial driving motor unit 40, the motor being cooled by the filtered air flow drawn through the cleaner by the fans. The air enters an inlet opening (not shown) in the top of the fan unit casing and is exhausted at the motor end through a cylindrically shaped motor-blower guard 42 that is formed with exhaust apertures (only some of which are illustrated) in the wall and secured to the motor frame.

Formed in the front wall of the upper housing is a central opening 44 within which is inserted an intake connector 46 having a flange portion 48 and a cylindrical extension 50. The connector is secured in the upper housing by means of its front flange portion 48 and an annular retaining ring 52 which together lock the connector axially to the upper housing. A hose 54 fitted with a coupling 56 having an adapter 58 at its other end is connected into a frontal opening 60 of the connector 46. The disposable filter bag 24 includes a mounting collar 62 which slips on to the cylindrical extension 50 of the connector 46 and is held thereon by friction so that the dirt and dust in the inlet air stream passing through the hose 54 remains in the bag as the air is drawn through the vacuum or filter bag compartment by the motor-blower assembly.

In accordance with the preferred embodiment of the present invention, an aperture 64 is formed in the floor of the filter bag access door 26. A valve plate 66 is pivotably journaled on a hinge pin 68 mounted in the floor of the access door and spaced laterally and forwardly of the aperture 64 so that the valve plate is pivotable into and out of overlaying relationship with the aperture. Thus, the valve plate may entirely close partially close or open the aperture depending upon the angle that the valve plate is pivoted through.

Formed on the valve plate 66 are a pair of spaced ribs 70 which extend laterally across the valve parallel to one another and sloped from adjacent the forward edge 72 of the valve 66 to adjacent the rear edge 74 of the valve. The space between the ribs 70 define a cam groove 76. Secured by means of screws (not illustrated) to the filter bag access door 26 above the valve 66 and the aperture 64 is a small housing or bonnet 78 having a plurality of windows 80*a*, 80*b*, . . . 80*f* in the top thereof and a laterally extending narrow slot 82 in the front face just above the access door 26. A stud 84 acting as a cam follower is positioned within the groove 76 and is preferably formed integral with an arm 86 a portion of which extends out of the slot 82 to define an operator 88. Preferably, depending downwardly from the underside of the arm 86 is a tab 90, the side of which abuts a ledge 92 formed on the upper surface of the access door to provide a lateral guide. Thus, as the operator slides laterally, the stud 84 within the groove 76 acts against the appropriate rib 70 to provide a movement about the hinge 68 to force the valve plate 66 to pivot, thereby varying the degree of opening of the aperture 64. Since the aperture 64 opens into the filter bag compartment, it communicates the filter bag compartment with ambient conditions through the bonnet slot 82. Thus, with the valve opening the aperture, ambient air is allowed to bleed through the slot 82 through the bonnet and into the filter bag compartment to lower the negative pressure in the cleaner and thereby the suction at the hose inlet. The degree of reduced suction is depended upon the amount the aperture is open which in turn is determined by the position of the operator 88 and indicated by the lateral position of the operator in the slot 82. The windows 80*a*, etc., may include indicia showing the cleaning chores most efficiently cleaned by the suction chosen as indicated by the registration of the operator with the windows.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims. /

Having thus set forth the nature of this invention, what we heretofore claim is:

1. In a vacuum cleaner of the canister type comprising a housing having a filter compartment including an inlet and an outlet, a porous filter bag mounted in said filter compartment in flow communication with said inlet, means for creating sub-atmospheric pressure in said compartment and said bag for drawing dirt laden air through said inlet and discharging filtered air through said outlet, the improvement comprising a suction control for controlling the pressure in the filter compartment, said control comprising an aperture in said housing communicating said filter bag compartment with the exterior of said housing, a valve member, mounting means spaced from the aperture for pivotably mounting the valve member on the housing for movement in the plane of the aperture between positions covering and uncovering the aperture, and control means for selectively pivoting said valve member including an operator, means for constraining said operator for slidable movement in a path substantially parallel to said plane, a cam track formed on said valve skewed with respect to said path, and a stud secured to said operator and positioned on said track for pivoting said valve about the mounting means as said operator is moved in said path.

2. In a vacuum cleaner as recited in claim 1 including a bonnet mounted on said housing above said filter bag compartment enveloping said valve, said bonnet including a slot, said operator projecting through said slot to the exterior of said cleaner, said means for constraining said operator comprising cooperating means on said bonnet about the border of said slot and on said operator, and indicia spaced on said bonnet aligned with said slot for indicating the relative pressure in the bag chamber selected by the operator.

* * * * *